US010910732B2

(12) United States Patent
Samadi Taheri et al.

(10) Patent No.: US 10,910,732 B2
(45) Date of Patent: Feb. 2, 2021

(54) COLLOCATED END-FIRE ANTENNA AND LOW-FREQUENCY ANTENNA SYSTEMS, DEVICES, AND METHODS

(71) Applicant: wiSpry, Inc., Irvine, CA (US)

(72) Inventors: Mohammad Mehdi Samadi Taheri, Tehran (IR); Shuai Zhang, Aalborg SV (DK); Gert Frølund Pedersen, Storvorde (DK)

(73) Assignee: WISPRY, INC., Irvine, CA (US)

( * ) Notice: Subject to any disclaimer, the term of this patent is extended or adjusted under 35 U.S.C. 154(b) by 0 days.

(21) Appl. No.: 16/157,683

(22) Filed: Oct. 11, 2018

(65) Prior Publication Data

US 2019/0109387 A1 Apr. 11, 2019

Related U.S. Application Data

(60) Provisional application No. 62/570,930, filed on Oct. 11, 2017.

(51) Int. Cl.
*H01Q 21/30* (2006.01)
*H01Q 21/28* (2006.01)
(Continued)

(52) U.S. Cl.
CPC ..... *H01Q 21/28* (2013.01); *H01Q 1/521* (2013.01); *H01Q 5/15* (2015.01); *H01Q 5/307* (2015.01);
(Continued)

(58) Field of Classification Search
CPC ..... H01Q 1/521; H01Q 5/307; H01Q 9/0414; H01Q 21/29
See application file for complete search history.

(56) References Cited

U.S. PATENT DOCUMENTS 4,835,538 A * 5/1989 McKenna ..... H01Q 9/0414 343/700 MS
7,079,079 B2 * 7/2006 Jo ..... H01Q 1/243 343/700 MS
(Continued)

FOREIGN PATENT DOCUMENTS

WO WO 2017/056437 A1 4/2017
WO WO 2019/075190 A1 4/2019

OTHER PUBLICATIONS

International Search Report and Written Opinion for Application No. PCT/US2018/055393 dated Feb. 14, 2019.
(Continued)

*Primary Examiner* — Ab Salam Alkassim, Jr.
(74) *Attorney, Agent, or Firm* — Jenkins, Wilson, Taylor & Hunt, P.A.

(57) ABSTRACT

Antenna systems, devices, and methods for providing both end-fire mm-wave high-frequency signals and low-frequency RF signals from a collocated antenna array in which at least one high-frequency antenna element and a low-frequency antenna element are spaced apart from one another. Grating strips are positioned between the high-frequency antenna elements and the low-frequency antenna element, the grating strips being spaced apart from one another by a defined spacing. The grating strips are configured such that a signal wave from the high-frequency antenna element propagates through the low-frequency antenna element.

14 Claims, 11 Drawing Sheets

(51) Int. Cl.

| | |
|---|---|
| ***H01Q 19/10*** | (2006.01) |
| ***H01Q 5/15*** | (2015.01) |
| ***H01Q 5/48*** | (2015.01) |
| ***H01Q 5/307*** | (2015.01) |
| ***H01Q 21/06*** | (2006.01) |
| ***H01Q 9/42*** | (2006.01) |
| ***H01Q 9/26*** | (2006.01) |
| ***H01Q 1/52*** | (2006.01) |
| ***H01Q 21/08*** | (2006.01) |
| ***H01Q 19/28*** | (2006.01) |
| ***H01Q 15/00*** | (2006.01) |
| *H01Q 9/16* | (2006.01) |

(52) U.S. Cl.

CPC ..... *H01Q 5/48* (2015.01); *H01Q 9/26* (2013.01); *H01Q 9/42* (2013.01); *H01Q 15/0013* (2013.01); *H01Q 19/108* (2013.01); *H01Q 19/28* (2013.01); *H01Q 21/062* (2013.01); *H01Q 21/08* (2013.01); *H01Q 21/30* (2013.01); *H01Q 9/16* (2013.01)

(56) References Cited

U.S. PATENT DOCUMENTS

| | | | | |
|---|---|---|---|---|
| 2004/0174302 | A1 | 9/2004 | Robin | |
| 2007/0176829 | A1* | 8/2007 | Liu | H01Q 9/0421 343/702 |
| 2010/0328160 | A1* | 12/2010 | Hsu | H01Q 9/0464 343/700 MS |
| 2012/0293387 | A1 | 11/2012 | Ohno | |
| 2013/0027268 | A1* | 1/2013 | Ohno | H01Q 9/285 343/818 |
| 2015/0255854 | A1 | 9/2015 | Lin et al. | |
| 2015/0349408 | A1 | 12/2015 | Tsou et al. | |
| 2017/0012359 | A1* | 1/2017 | Jung | H01Q 3/30 |
| 2017/0346179 | A1* | 11/2017 | Wu | H01Q 1/523 |
| 2018/0269577 | A1* | 9/2018 | Kosaka | H01Q 19/17 |
| 2020/0059009 | A1* | 2/2020 | Sonoda | H01Q 19/10 |

OTHER PUBLICATIONS

Chinese Office Action for Application No. 201880066297.8 dated Oct. 10, 2020.

* cited by examiner

ANTENNA 1 ANTENNA 2 ANTENNA 3 ANTENNA 4

COLLOCATED END-FIRE ANTENNA AND LOW-FREQUENCY ANTENNA SYSTEMS, DEVICES, AND METHODS

PRIORITY CLAIM

The present application claims the benefit of U.S. Patent Ser. No. 62/570,930, filed Oct. 11, 2017, the disclosure of which is incorporated herein by reference in its entirety.

TECHNICAL FIELD

The subject matter disclosed herein relates generally to mobile antenna systems and devices.

BACKGROUND

In a 5G phased array antenna, it can be desirable to collocate an end-fire mm-wave high-frequency antenna element and a low-frequency antenna element for mobile terminal applications. In general, however, by placing a low-frequency antenna strip in front of a high-frequency antenna block, the end-fire radiation pattern of mm-wave antenna, and consequently the signal wave, would be disrupted resulting in reduced gain in the end-fire direction and increased radiation in undesired directions.

SUMMARY

In accordance with this disclosure, antenna systems, devices, and methods for providing both end-fire mm-wave high-frequency signals and low-frequency RF signals from a collocated antenna array are provided. In one aspect, an antenna array is provided in which at least one first antenna element and a second antenna element are spaced apart from one another, wherein the first antenna element is configured to radiate at a first frequency and the at least one second antenna element is configured to radiate at a second frequency that is lower than the first frequency. A plurality of grating strips is positioned between the at least one first antenna element and the second antenna element, the plurality of grating strips having a defined pitch and being spaced apart from one another by a defined spacing, wherein the plurality of grating strips is configured such that a signal wave from the at least one first antenna element propagates through the second antenna element.

In another aspect, a method for operating a collocated antenna array comprises generating a signal wave from at least one first antenna element, transmitting a first portion of the signal wave through a plurality of grating strips that are spaced apart from one another by a defined spacing, and transmitting at least a first part of the first portion of the signal wave through a second antenna element that is spaced apart from the first antenna element.

Although some of the aspects of the subject matter disclosed herein have been stated hereinabove, and which are achieved in whole or in part by the presently disclosed subject matter, other aspects will become evident as the description proceeds when taken in connection with the accompanying drawings as best described hereinbelow.

BRIEF DESCRIPTION OF THE DRAWINGS

The features and advantages of the present subject matter will be more readily understood from the following detailed description which should be read in conjunction with the accompanying drawings that are given merely by way of explanatory and non-limiting example, and in which.

DETAILED DESCRIPTION

The present subject matter provides systems, devices, and methods for co-locating an end-fire mm-wave 5G phased array of high-frequency antenna elements and a low-frequency antenna element for mobile terminal applications. There is generally only a small amount of space available for locating any antenna element on a mobile terminal because much of the space is devoted to other parts of the mobile device (e.g., screen, battery), many of which are metallic and thereby affect the radiation pattern and performance of the antenna. As a result, antenna elements are commonly placed in small spaces on the top or bottom of the mobile terminal. Working within these constraints, the present subject matter provides for the integration of a broadside-radiation-pattern high-frequency antenna with a low-frequency antenna. The placement of the high-frequency antenna array occupies a very small space (e.g., less than 0.007 wavelength of the low-frequency antenna), with the entire antenna array occupying less than 0.03 wavelength of the low-frequency antenna.

Figure 1A:
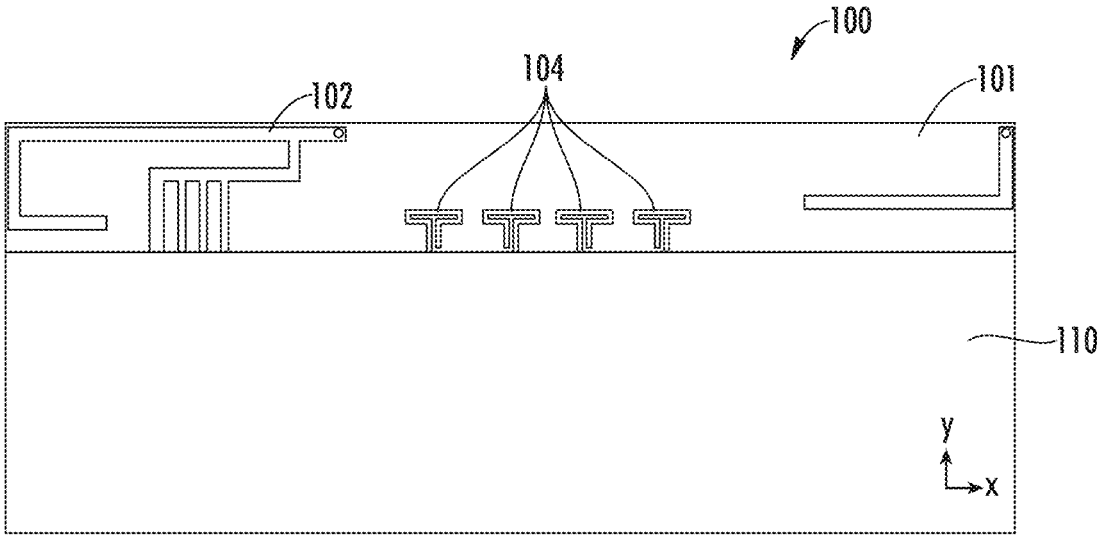
FIGS. 1A and 1B are front and rear views of an integrated low- and high-frequency, end-fire phased array antenna according to an embodiment of the presently disclosed subject matter.

An exemplary configuration for an antenna system according to the present subject matter is shown in FIGS. 1A through 3. In this embodiment, an antenna array, generally designated 100, includes both a low-frequency antenna element 102 and one or more high-frequency antenna elements 104 that are spaced apart from low-frequency antenna element 102. In some embodiments, low-frequency antenna element 102 is a planar inverted-F antenna (PIFA), which can be spaced apart from a ground plane 110. Referring to FIGS. 1A and 1B, low-frequency antenna element 102 is illustrated as a C-fed dual band PIFA antenna, although those having ordinary skill in the art will recognize that any of a variety of well-known antenna configurations can be used to provide the desired coverage of low-frequency signals. Regardless of its particular configuration, low-frequency antenna element 102 is configured to operate at relatively low frequencies, such as in one or more of LTE frequency bands from 740-960 MHz and/or 1.7-2.2 GHz. Further, in some embodiments, low-frequency antenna element 102 is tunable, such as by tuning one or more capacitance connected at a feeding point of low-frequency antenna elements 102, to provide wide band performance.

Figure 1B:
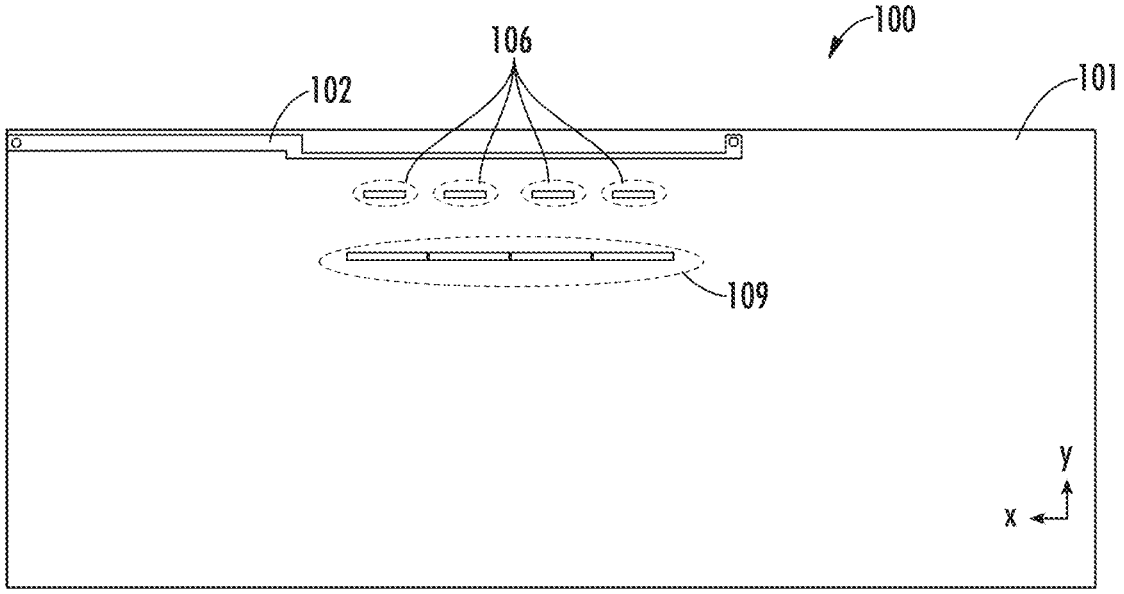
Figure 2:
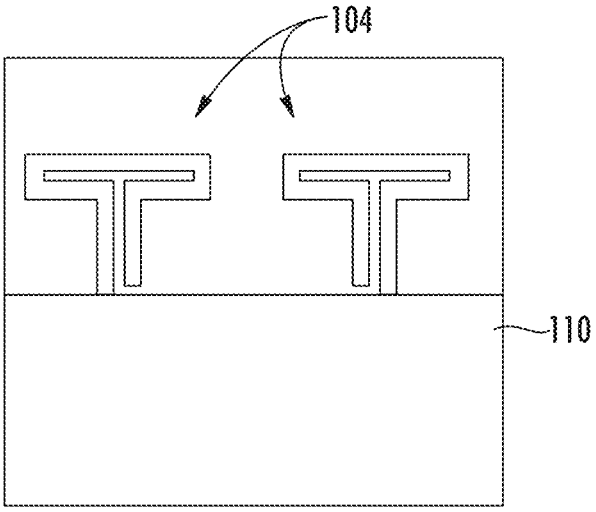
FIG. 2 is a front view of high-frequency end-fire antenna elements for use in an antenna array according to an embodiment of the presently disclosed subject matter.
Figure 3:
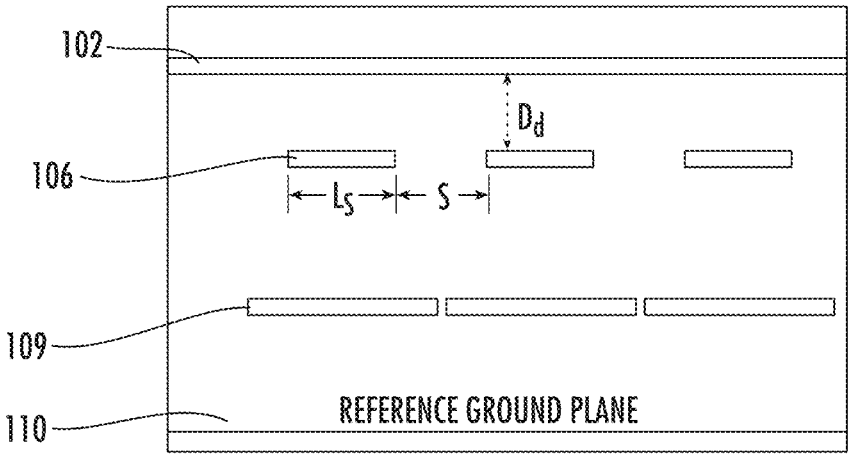
FIG. 3 is a rear view of elements of an integrated low- and high-frequency, end-fire phased array antenna according to an embodiment of the presently disclosed subject matter.

In some embodiments, high-frequency antenna elements 104 comprise folded dipole antenna elements, although those having ordinary skill in the art will recognize that such antenna elements can be replaced with any of a variety of mm-wave end-fire antenna elements. In the embodiment illustrated in FIGS. 1A-1B, high-frequency antenna elements 104 include four elements, although those having ordinary skill in the art will further recognize that the number of elements can be selected to achieve the desired antenna performance. In some embodiments, to increase the total scan angle and coverage efficiency in the presence of a comparatively large ground plane 110 in a collocated configuration, high-frequency antenna elements 104 can be arranged alternatively such that, for each of high-frequency antenna elements 104 that is fed from a left side, an adjacent one of high-frequency antenna elements 104 is fed from the right side as illustrated in FIG. 2. This feeding arrangement can be configured to provide a 180-degree phase difference for alternate antenna elements. In addition, in some embodiments, high-frequency antenna elements 104 comprise a phased array of high-frequency antenna elements such that a signal wave generated by high-frequency antenna elements 104 is steerable in a desired direction.

In any configuration, high-frequency antenna elements 104 are configured to operate at relatively high frequencies, such as at 5G mm-wave frequencies between about 22-31 GHz. In some embodiments, such high-frequency antenna elements 104 exhibit high gain with a steerable beam. As discussed above, in conventional arrangements, by placing low-frequency antenna element 102 in front of high-frequency antenna elements 104, the end-fire radiation pattern of high-frequency antenna elements 104, and consequently the signal wave, would not be able to propagate in the main direction. As implemented according the present subject-matter, however, collocation of low-frequency antenna element 102 and high-frequency antenna elements 104 in a small space without interference of performance is made possible by configuring low-frequency antenna element 102 to be effectively transparent to the signal wave generated by high-frequency antenna elements 104.

To achieve such effective transparency and enable the collocation of the antenna elements, in some embodiments, a plurality of anti-reflective grating strips 106 is positioned between high-frequency antenna elements 104 and low-frequency antenna element 102. Referring to the embodiment illustrated in FIGS. 1A-1B, high-frequency antenna elements 104 are arranged on a first, "top" side of a substrate 101, and a plurality of grating strips 106 are positioned on an opposing second, "bottom" side of substrate 101 opposing the top side. Those having ordinary skill in the art will recognize that placement of grating strips 106 on either of the top side or the bottom side of substrate 101 can have similar effects, although placing grating strips 106 on the bottom side as illustrated in FIG. 1B allows the pattern of high-frequency antenna elements 104 to be arranged more symmetrically and can help compensate for the effect of a large ground plane 110. In some embodiments, grating strips 106 are composed of a material having good conductivity.

In addition, as illustrated in FIG. 1B, a plurality of strip reflectors 109 can be added at the bottom side of substrate 101 to improve the matching of high-frequency antenna elements 104. In some embodiments, these reflectors 109 are configured not only to improve antenna matching but also to improve the antenna performance, such as gain, to reduce the large ground effect on the antenna radiation pattern, and/or to reduce the surface wave. In some embodiments, the dimensions of reflectors 109 are selected to be a little larger than a quarter of a wavelength of a signal in the desired high-frequency operating bands. In some embodiments, the spacing between reflectors 109 and the spacing from ground plane 110 are optimized to have the best operation in matching and radiation pattern.

Regardless of the particular configuration, grating strips 106 can be arranged next to one another in an array in which they are both substantially parallel with low-frequency antenna element 102 and substantially parallel with respect to one another, with adjacent grating strips 106 being separated from one another by a defined spacing. In some embodiments, the plurality of grating strips 106 are individual elements that are aligned at predetermined intervals. Alternatively, in other embodiments, the plurality of grating strips 106 are elements of a single piece of material having one or more openings (e.g., slots) formed therein to define a pattern of strips 106 and gaps. In yet further alternative embodiments, grating strips 106 are provided in the form of a director associated with each of high-frequency antenna elements 104, which can result in an increased antenna gain.

In any configuration, grating strips 106 can be positioned and/or configured to adjust the way in which a signal wave from high-frequency antenna elements 104 can propagate through low-frequency antenna element 102 with minimum interference, which results in a substantially end-fire radiation pattern. In addition to achieving a substantially end-fire radiation pattern, the value of realized gain of high-frequency antenna elements 104 is approximately the same as the gain of high-frequency antenna elements 104 alone as if they were not collocated with low-frequency antenna element 102. In other words, low-frequency antenna element 102 is effectively transparent with respect to the high-frequency signals.

In some embodiments, one or more of the inter-gap width Ls of the grating strips, which can be defined by a length of each of grating strips 106, a spacing S of the gaps between adjacent pairs of grating strips 106, and a distance Dd between grating strips 106 and low-frequency antenna element 102 is selected to achieve the desired radiation pattern. In some embodiments, for example, distance Dd between grating strips 106 and low-frequency antenna element 102 is approximately one quarter of a wavelength of low-frequency antenna element 102. By adjusting this spacing, the effective transparency of grating strips 106 and low-frequency antenna element 102 can be optimized. The other parameters, such as spacing S and width Ls, are similarly selected to affect the shape of the radiation pattern and the level of realized gain. In one exemplary embodiment, for example, desirable operation at an operating frequency of approximately 28 GHz is achieved where the value of width Ls=1.8 mm, the value of spacing S=0.85 mm, and the value of distance Dd=2 mm. That being said, those having ordinary skill in the art will recognize that different values for the parameters of width Ls, spacing S, and distance Dd may be used depending on the particular configuration of the antenna elements and/or the mobile terminal into which the antenna system is integrated.

Figure 4:
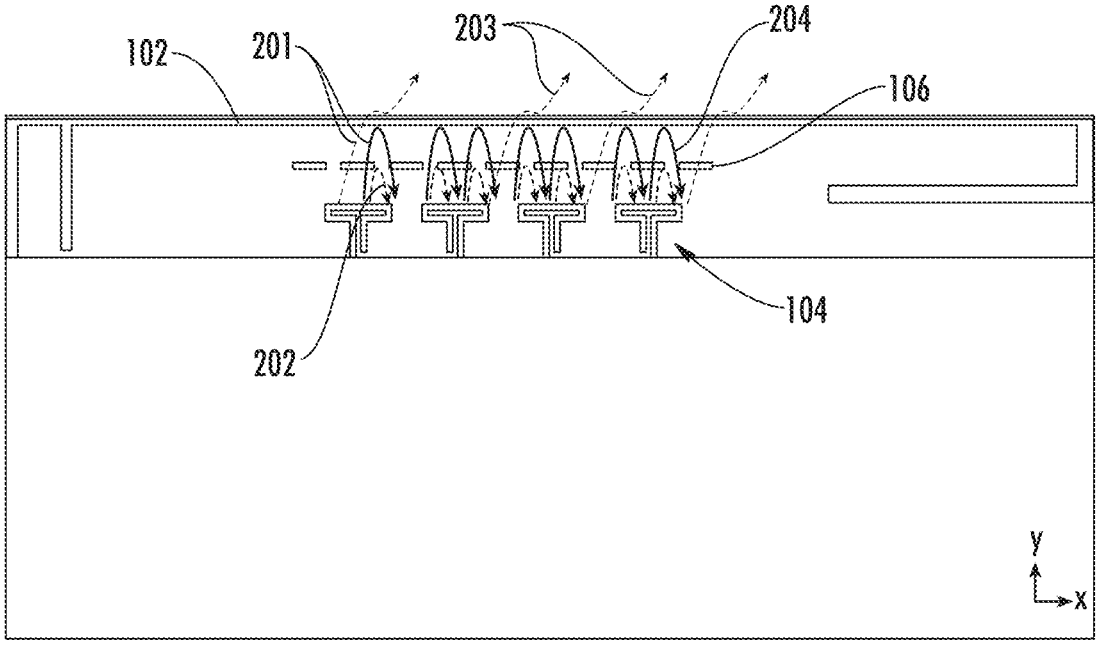
FIG. 4 is a schematic view of elements of an integrated low- and high-frequency, end-fire phased array antenna according to an embodiment of the presently disclosed subject matter.

In this arrangement, grating strips 106 are configured to modify the way in which the signal wave generated by high-frequency antenna elements 104 interacts with low-frequency antenna element 102 such that a desired end-fire radiation pattern is preserved. As illustrated in FIG. 4, for example, when a signal wave at a mm-wave frequency range (e.g., having frequencies between about 22-31 GHz) propagates from high-frequency antenna elements 104, grating strips 106 act as an antireflective surface such that a first portion 201 of the wave is transmitted and a second portion 202 is reflected back towards high-frequency antenna elements 104. First portion 201 of the signal wave can further be diffracted at low-frequency antenna element 102, with a transmitted portion 203 of first portion 201 being transmitted and a reflected portion 204 being reflected by low-frequency antenna element 102. Because the two reflected waves (i.e., second portion 202 reflected by grating strips 106 and reflected portion 204 reflected by low-frequency antenna element 102) that reach the high-frequency elements are out of phase with respect to one another, however, they cancel each other. To achieve this result, in some embodiments, distance Dd between grating strips 106 and low-frequency antenna element 102 is approximately one quarter of a wavelength of low-frequency antenna element 102. In this way, transmitted portion 203 of the signal wave can propagate in the end-fire direction without interference.

Figure 5A:
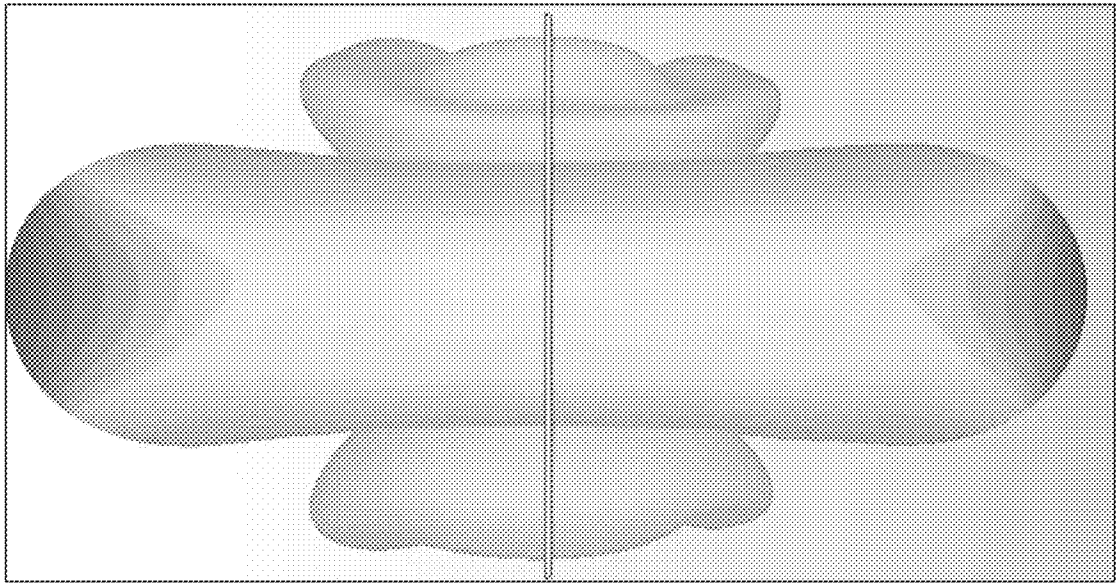
FIGS. 5A and 5B are graphs illustrating radiation patterns of collocated low- and high-frequency antenna arrays at 28 GHz according to embodiments of the presently disclosed subject matter.
Figure 5B:
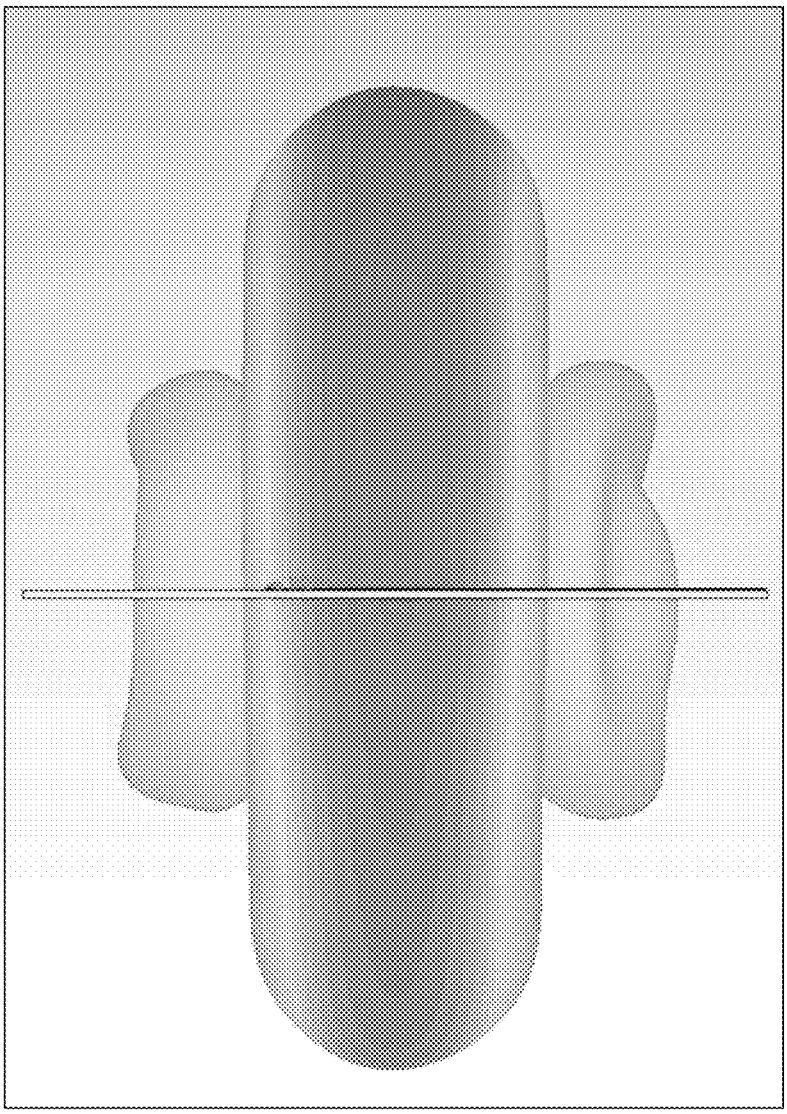

In some embodiments, the effect of grating strips 106 between low-frequency antenna element 102 and high-frequency antenna elements 104 are shown in FIGS. 5A and 5B. As illustrated in FIG. 5A, when there are no grating strips between high-frequency antenna elements 104 and low-frequency antenna element 102, the signal wave produced by high-frequency antenna elements 104 is reflected downward, and the resulting radiation pattern is not totally end-fire. By inserting grating strips 106 between low-frequency antenna element 102 and high-frequency antenna elements 104 and by adjusting widths Ls of grating strips 106, spacing S between them, and distance Dd between grating strips 106 and low-frequency antenna element 102, the end-fire radiation pattern can be obtained as shown in FIG. 5B.

Figure 6:
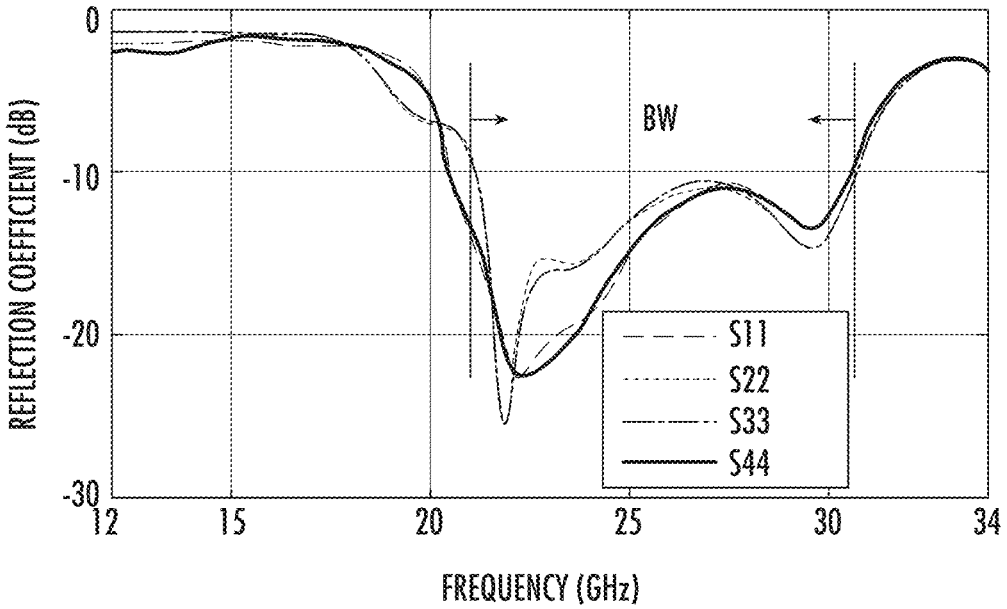
FIG. 6 is a graph illustrating simulated scattering parameters of collocated mm-wave high-frequency antennas according to an embodiment of the presently disclosed subject matter.
Figure 7:
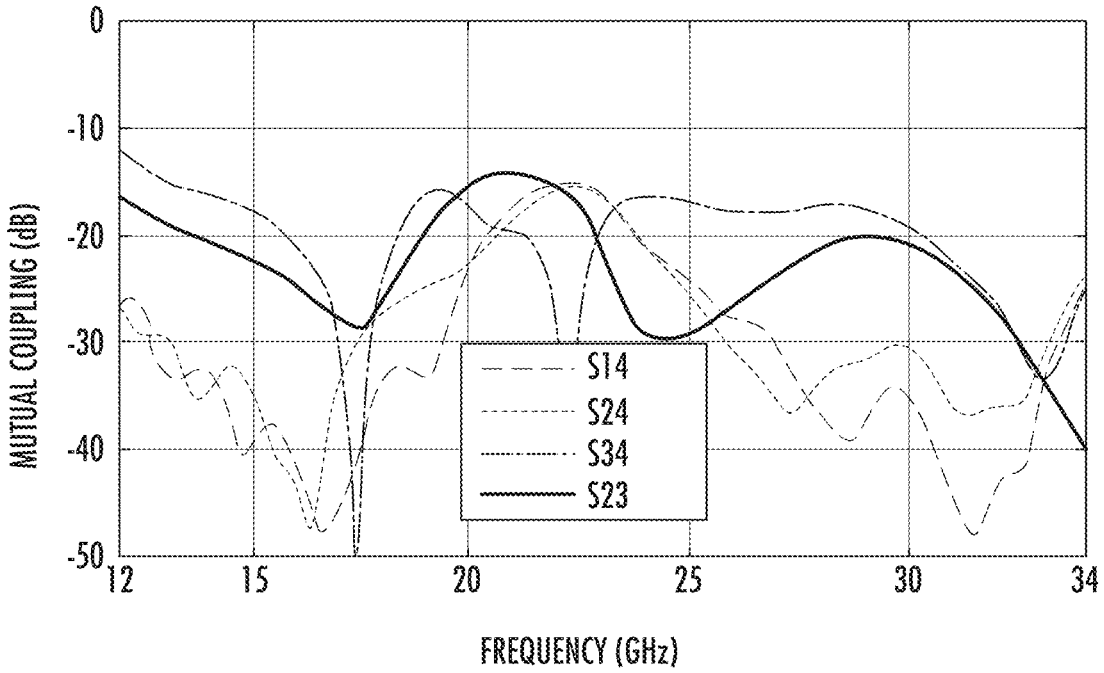
FIG. 7 is a graph illustrating simulated mutual coupling of collocated mm-wave high-frequency antennas according to an embodiment of the presently disclosed subject matter.

A configuration for a complete, integrated mm-wave four-element antenna array with a dual-band low-frequency antenna system according to the present subject matter has been modeled and simulated with full wave CST microwave studio software. In addition, an optimized prototype has been fabricated and measured in large anechoic chamber for measuring the radiation pattern of a high-frequency mm-wave antenna array. The proposed dual band low-frequency antenna has been measured in a SATIMO chamber. The simulated scattering parameters of collocated mm-wave high-frequency antenna are shown in FIG. 6. As illustrated, the proposed antenna array has good reflection coefficient better than −10 dB over frequency bands 22-31 GHz. The simulated mutual coupling between high-frequency antennas in collocated topology is shown in FIG. 7. As illustrated, the proposed antenna array has a very good mutual coupling better than −15 dB in the whole operating bandwidth. It should be noticed that at 28 GHz, the mutual coupling is better than −18 dB.

Figure 8:
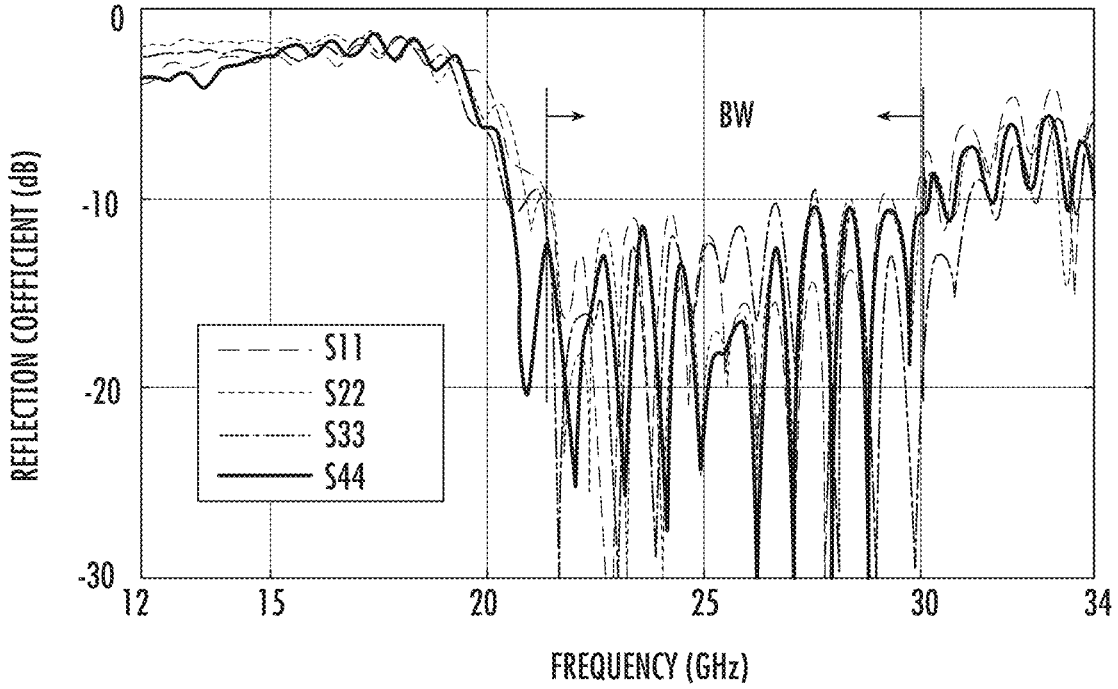
FIG. 8 is a graph illustrating measurement scattering parameters of collocated mm-wave high-frequency antennas according to an embodiment of the presently disclosed subject matter.
Figure 9:
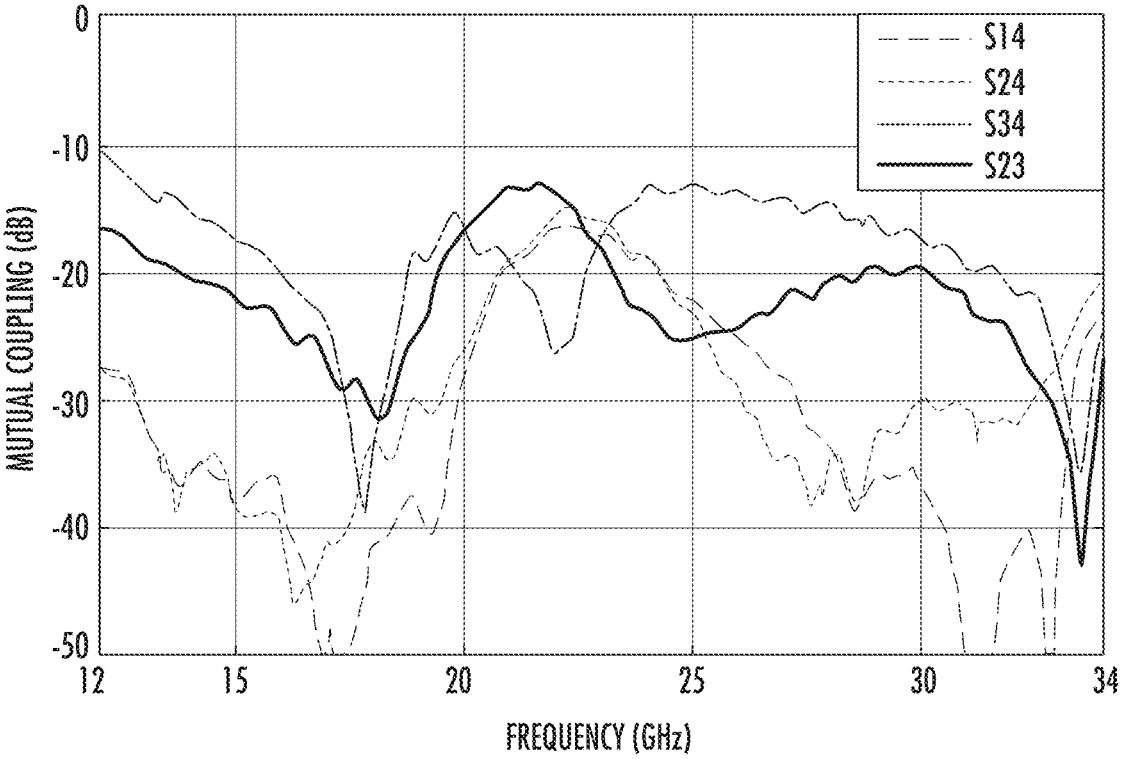
FIG. 9 is a graph illustrating measured mutual coupling of collocated mm-wave high-frequency antennas according to an embodiment of the presently disclosed subject matter.

The measurement scattering parameters of collocated mm-wave high-frequency antennas are shown in FIG. 8. The measurement is carried out with 67 GHz four port N5227A PNA Microwave Network Analyzer. As illustrated, the proposed fabricated high-frequency antenna array has good reflection coefficient better than −10 dB over frequency bands 22-31 GHz. The measured mutual coupling between the elements of the high-frequency antenna array in the collocated topology is shown in FIG. 9. As illustrated, the proposed antenna array has a very good mutual coupling better than −13 dB in the whole operating bandwidth. It should be noticed that in 28 GHz the mutual coupling is better than −16 dB. As illustrated, the measured results substantially agree well with the simulated ones.

Figure 10:
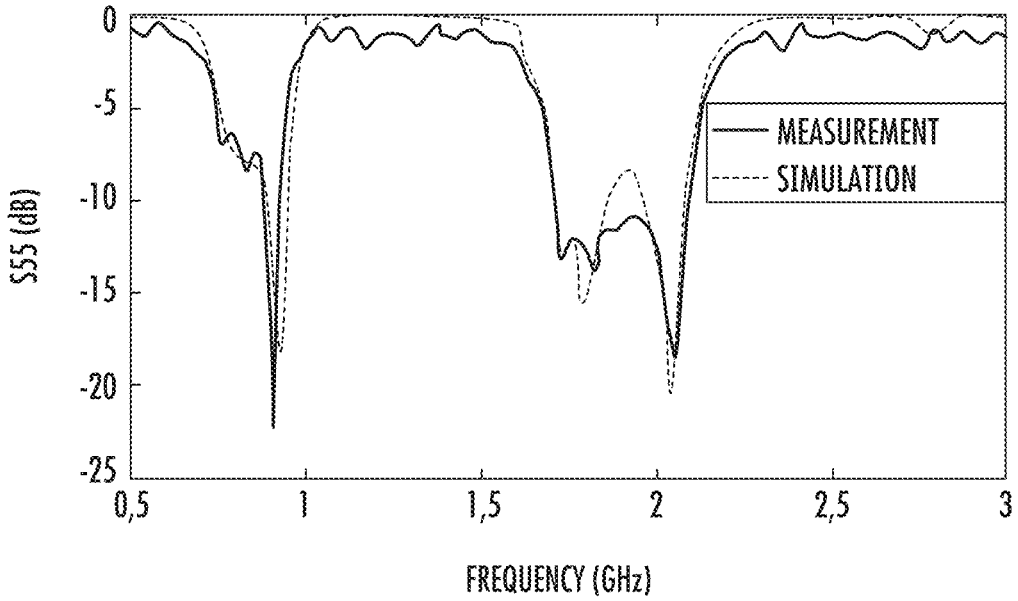
FIG. 10 is a graph illustrating simulated and measured values of scattering parameters of a dual band low-frequency antenna according to an embodiment of the presently disclosed subject matter.
Figure 11:
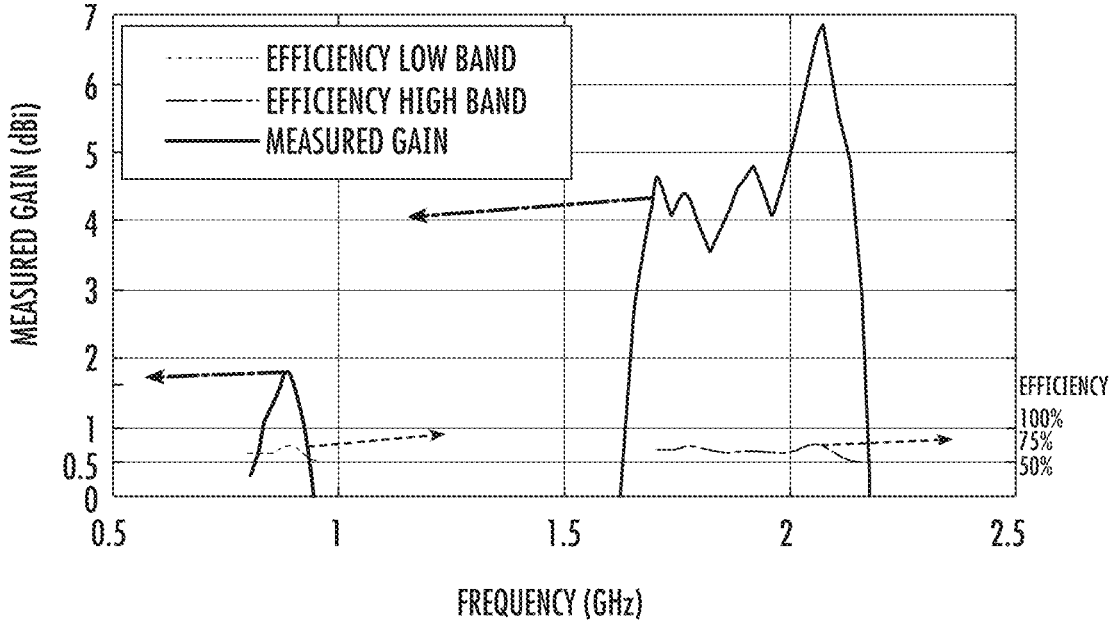
FIG. 11 is a graph illustrating low-frequency antenna gain and antenna total efficiency in the collocated low and mm-wave high-frequency antenna according to an embodiment of the presently disclosed subject matter.

The simulated and measurement of scattering parameters of a dual band low-frequency antenna is presented in FIG. 10. The proposed antenna has good impedance bandwidth, better than −6 dB, from 750-960 MHz and 1.7-2.2 GHz that covers some practical bands in 4G LTE. There is good agreement between simulation and measurement. The low-frequency antenna gain and total efficiency is shown in FIG. 11. Total antenna efficiency as shown in FIG. 11 in best case is better than 75 percent and it is better than 50 percent totally in the whole frequency bands. The antenna gain as shown in FIG. 11 is more than 0.35 dBi and 3.6 dBi in 750-960 MHz and 1.7-2.2 GHz frequency bands, respectively.

Figure 12A:
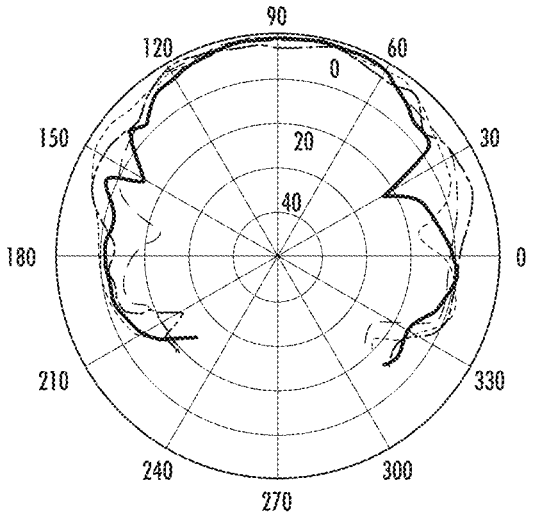
FIGS. 12A, 12B, and 12C are graphs illustrating measured antenna radiation pattern at H-plane at frequencies of 26, 28, and 30 GHz, respectively, according to an embodiment of the presently disclosed subject matter.
Figure 12B:
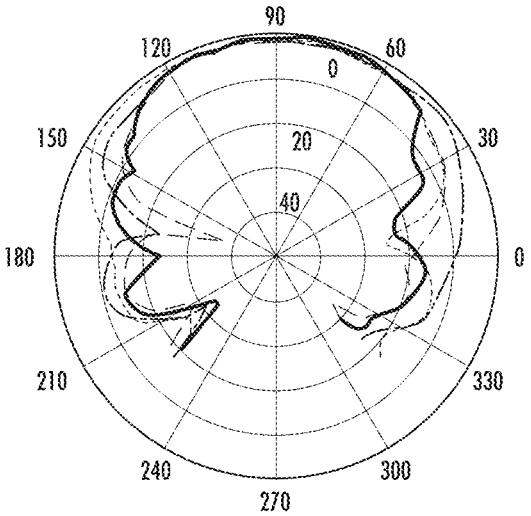
Figure 12C:
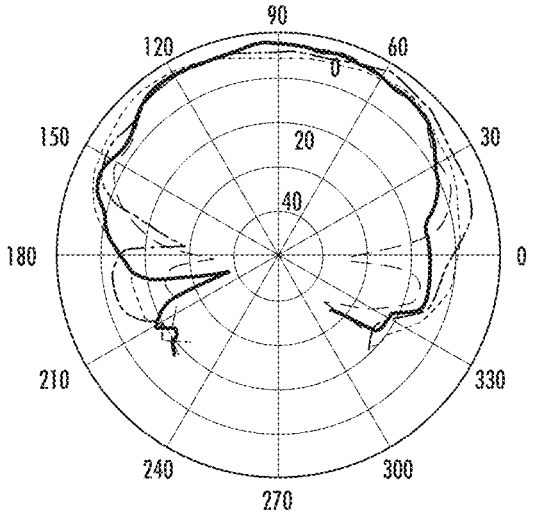
Figure 13A:
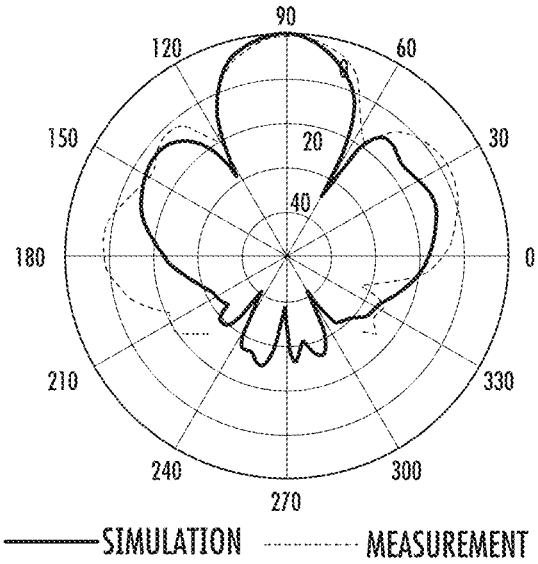
FIGS. 13A, 13B, and 13C are graphs illustrating measured radiation patterns of a proposed antenna array according to an embodiment of the presently disclosed subject matter.
Figure 13B:
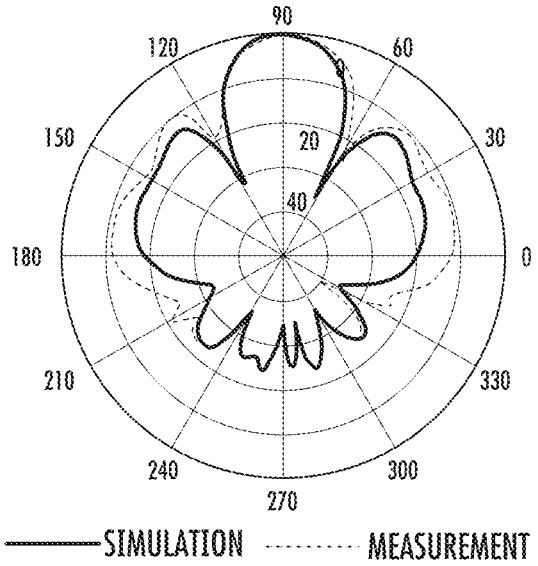
Figure 13C:
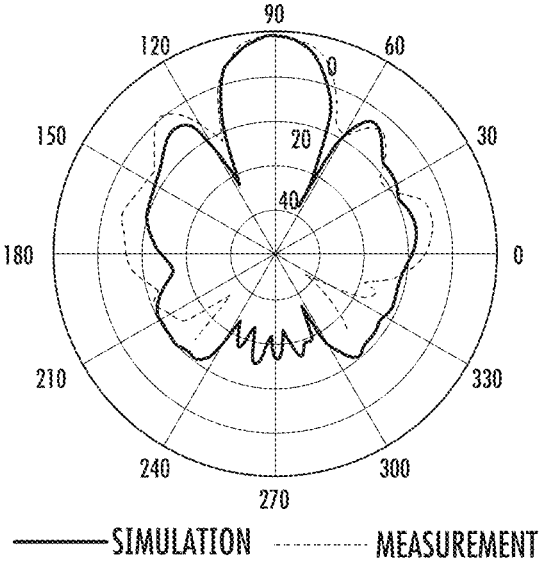

The antenna radiation pattern as stated before was further measured in an anechoic chamber. The 3D radiation pattern of high-frequency antenna elements has been measured in large anechoic chamber one by one. The 3D antenna radiation pattern has been measured in anechoic chamber with good angular precision from 22-31 GHz. The antenna measured and simulated radiation pattern at H-plane at frequencies of 26, 28, and 30 GHz are shown in FIGS. 12A, 12B, and 12C, respectively. As illustrated, the antenna radiation pattern has a wide beamwidth radiation pattern in the H-plane that leads into wide scan coverage. After measuring each element radiation pattern, the total radiation pattern of four folded dipole elements of the array has been measured with a combination of three broadband 40 GHz combiners. The measured radiation pattern of proposed array with a combiner has been shown in FIGS. 13A-13C. As illustrated, there is a good agreement between simulated and measured results in the radiation pattern from 22-31 GHz.

Figure 14:
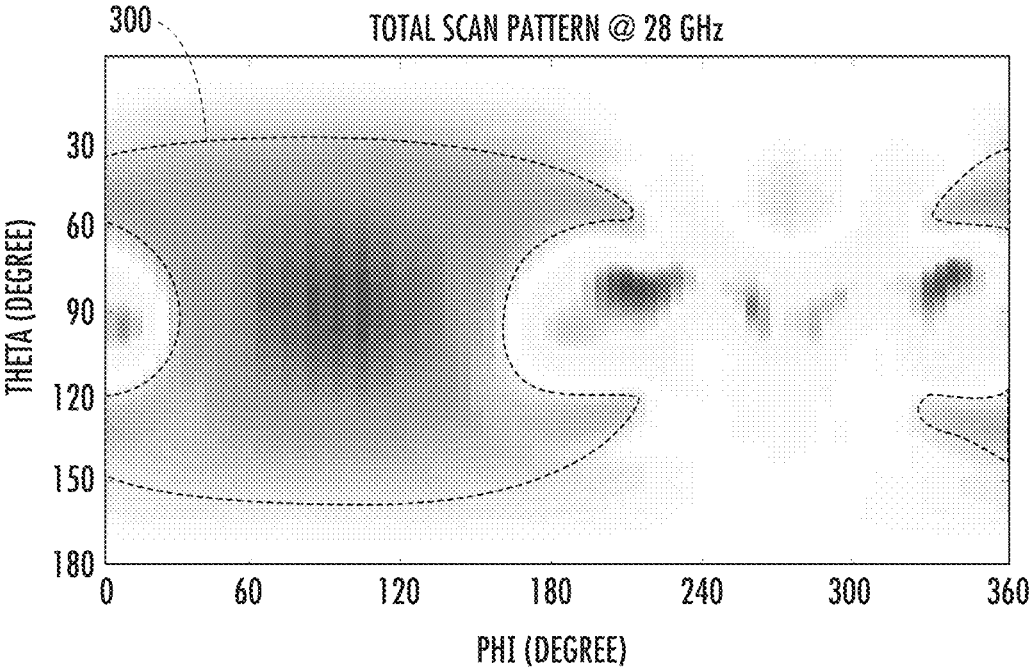
FIG. 14 is a graph illustrating total scan pattern of an antenna system at different directions at 28 GHz according to an embodiment of the presently disclosed subject matter.

The combination of the radiation pattern of the collocated high-frequency four element antenna array with different phasing is shown in FIG. 14. The proposed high-frequency antenna array has wide scan angle that covers ±50 degree in the H-plane. In the collocated topology with adding grating strips, the antenna radiation patterns remain purely end-fire, and in large scan angles, the pattern remains end-fire. If it is desired to scan over a large scan angle, the main element has such capability that can scan over a larger angle, although the number of high-frequency elements may be increased in such a situation.

Figure 15:
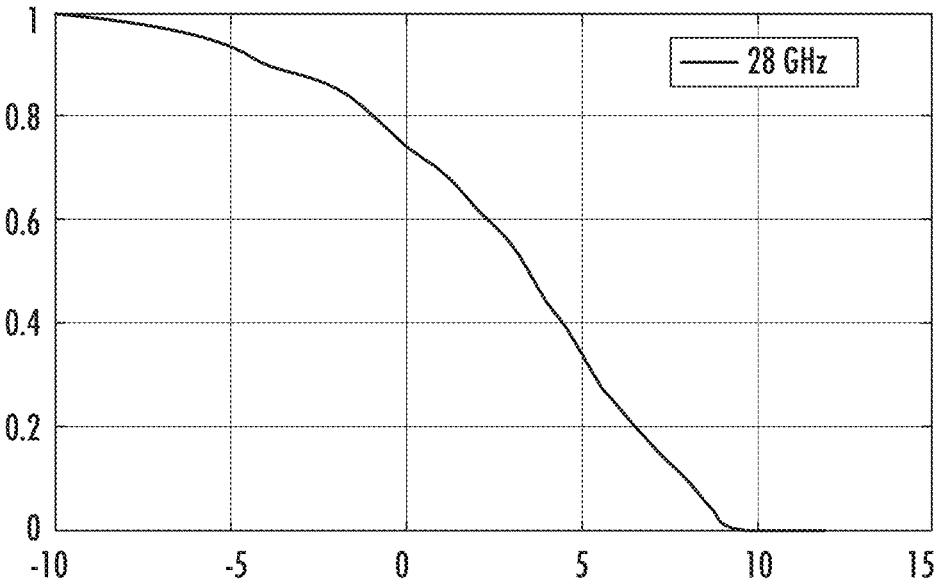
FIG. 15 is a graph illustrating coverage efficiency radiation pattern concept at 28 GHz of an antenna system according to an embodiment of the presently disclosed subject matter.

The total scan pattern of antenna at different direction has been presented in FIG. 14. As illustrated, the proposed collocated high-frequency antenna with only four folded dipole elements has a total scan pattern that covers a very large region in space, generally designated 300, with extremely high gain. For example, the antenna has gain more than 7 dBi in more than half coverage region in space. The coverage efficiency radiation pattern concept is shown in FIG. 15.

The present subject matter can be embodied in other forms without departure from the spirit and essential characteristics thereof. The embodiments described therefore are to be considered in all respects as illustrative and not restrictive. Although the present subject matter has been described in terms of certain preferred embodiments, other embodiments that are apparent to those of ordinary skill in the art are also within the scope of the present subject matter.

What is claimed is:

1. An antenna array comprising:

at least one first antenna element;

a second antenna element spaced apart from the first antenna element; and a plurality of grating strips positioned between the at least one first antenna element and the second antenna element, the plurality of grating strips being spaced apart from one another by a defined spacing;

wherein the first antenna element is configured to radiate at a first frequency and the at least one second antenna element is configured to radiate at a second frequency that is lower than the first frequency; and wherein the plurality of grating strips is configured such that a first portion of a signal wave from the at least one first antenna element that is reflected back towards the first antenna element by the second antenna element and a second portion of the signal wave that is reflected back towards the first antenna element by the plurality of grating strips are out of phase such that they substantially cancel each other such that a radiation pattern of the at least one first antenna element is substantially preserved beyond the second antenna element.

2. The antenna array of claim 1, wherein the at least one first antenna element comprises at least one mm-wave end-fire antenna element.

3. The antenna array of claim 1, wherein the second antenna element comprises a planar inverted-F antenna element.

4. The antenna array of claim 1, wherein the at least one first antenna element is mounted on a first side of a substrate; and wherein the second antenna element and the plurality of grating strips are mounted on a second side of the substrate opposing the first side.

5. The antenna array of claim 1, comprising a plurality of strip reflectors positioned and configured to improve matching of the at least one first antenna element.

6. The antenna array of claim 1, wherein the plurality of grating strips is configured such that one or more of an inter-gap width of the plurality of grating strips, a spacing between adjacent pairs of the plurality of grating strips, and a distance between the plurality of grating strips and the first antenna element are selected to achieve a desired end-fire radiation pattern for the at least one first antenna element.

7. The antenna array of claim 1, wherein the plurality of grating strips is configured such that the signal wave from the at least one first antenna element propagates through the second antenna element in a substantially end-fire radiation pattern.

8. A method for operating a collocated antenna array, the method comprising:

generating a signal wave from at least one first antenna element configured to radiate at a first frequency;

transmitting a first portion of the signal wave through a plurality of grating strips that are spaced apart from one another by a defined spacing;

transmitting at least a first part of the first portion of the signal wave through a second antenna element that is spaced apart from the first antenna element and is configured to radiate at a second frequency that is lower than the first frequency;

reflecting a second portion of the signal wave back towards the first antenna element by the plurality of grating strips; and reflecting a second part of the first portion of the signal wave back towards the first antenna element by the second antenna element;

wherein the second portion of the signal wave and the second part of first portion of the signal wave are out of phase such that they substantially cancel each other such that a radiation pattern of the at least one first antenna element is substantially preserved beyond the second antenna element.

9. The method of claim 8, wherein the signal wave comprises a millimeter-wave frequency range.

10. The method of claim 8, wherein the at least one first antenna element comprises at least one mm-wave end-fire antenna element.

11. The method of claim 8, wherein the second antenna element comprises a planar inverted-F antenna element.

12. The method of claim 8, wherein transmitting at least a first part of the first portion of the signal wave through the second antenna element comprises adjusting one or more of an inter-gap width of the plurality of grating strips, a spacing between adjacent pairs of the plurality of grating strips, and a distance between the plurality of grating strips and the first antenna element to achieve a desired end-fire radiation pattern for the at least one first antenna element.

13. The method of claim 8, wherein the first part of the first portion of the signal wave transmitted through the second antenna element comprises a substantially end-fire radiation pattern.

14. An antenna array comprising:

at least one first antenna element mounted on a first side of a substrate;

a second antenna element mounted on a second side of the substrate opposing the first side and spaced apart from the first antenna element; and a plurality of grating strips mounted on the second side of the substrate and positioned between the at least one first antenna element and the second antenna element, the plurality of grating strips being spaced apart from one another by a defined spacing;

wherein the first antenna element is configured to radiate at a first frequency and the at least one second antenna element is configured to radiate at a second frequency that is lower than the first frequency; and wherein the plurality of grating strips is configured such that a signal wave from the at least one first antenna element propagates through the second antenna element.

* * * * *